US005561953A

United States Patent [19]

Rotter

[11] Patent Number: 5,561,953

[45] Date of Patent: Oct. 8, 1996

[54] CONTOURED VENTILATION SYSTEM FOR METAL ROOFS

[76] Inventor: Martin J. Rotter, 115 Lismore Ave., Glenside, Pa. 19038

[21] Appl. No.: 347,977

[22] Filed: Dec. 1, 1994

[51] Int. Cl.[6] ..... E04H 12/28

[52] U.S. Cl. ..... 52/198; 52/302.1; 454/365

[58] Field of Search ..... 52/57, 198, 199, 52/408, 302.1, 302.3, 302.4, 302.5, 537, 538, 581, 588.1; 454/365

[56] References Cited

U.S. PATENT DOCUMENTS

| | | | |
|---|---|---|---|
| 2,160,642 | 5/1939 | Bumpas et al. . | |
| 3,884,009 | 5/1975 | Frohlich et al. | 52/302.1 X |
| 4,453,356 | 6/1984 | Kellogg et al. | 52/537 |
| 4,876,950 | 10/1989 | Rudeen | 98/42.21 |
| 4,942,699 | 7/1990 | Spinelli | 52/57 |
| 5,167,579 | 12/1992 | Rotter | 454/365 |
| 5,352,154 | 10/1994 | Rotter | 454/365 |

*Primary Examiner*—Kien T. Nguyen

*Attorney, Agent, or Firm*—Panitch Schwarze Jacobs & Nadel, P.C.

[57] ABSTRACT

A building structure adapted to allow for ventilation of vapors from within the structure so as to retard deterioration of the structure. A sloped roof has a decking and a sheet overlying the decking. The sheet has a plurality of projects projecting upward away from the decking. The sloped roof has a vent slot disposed along a roof ridge adapted to permit air from an interior space under the roof to flow through the slot to the exterior. A strip has a surface shaped to match the projections of the sheet. The strip has an air permeable and resilient portion. A ridge cap overlies the slot and the strip. The air permeable and resilient portion of the strip is adapted for the flow of vapors.

11 Claims, 5 Drawing Sheets

CONTOURED VENTILATION SYSTEM FOR METAL ROOFS

FIELD OF THE INVENTION

This invention is related to the general field of attic and roof ventilation systems and more particular to a method of ventilating a metal roof using a contoured air permeable and resilient strip.

BACKGROUND OF THE INVENTION

It has been a long known practice to ventilate attics under gable roofs by running a vent along the roof ridge. Such vents are created by an open slot running along the roof ridge, essentially the length of the roof, which causes ventilation out of the attic by convection airflow and by suction from wind blowing across the roof.

A soffit ventilation system is frequently used in conjunction with a ridge vent to provide passive ventilation. The soffit vents allow fresh ambient air to flow into the attic to equalize attic temperature and pressure with the outside. As stale hot air is withdrawn from the ridge slot vent by convection and/or wind suction, it is replaced by fresh ambient air entering the attic through the soffit vents.

The effectiveness of the ridge vent depends upon the degree to which convection outflow and wind across the vent line is uninhibited by the vent structure. Most effective would be a completely uncovered slot, but the need to keep out rain water, dirt and pests requires some sort of covering or capping structure. Design consideration for a vent structure includes, therefore, an attempt to maximize convection and suction outflow while establishing an effective barrier against water, dirt and insect entry, creating or maintaining an aesthetic appearance of the roof, long term durability, low cost construction, and ease of installation.

Differences between the various types of ridge vents are often found in the capping structures used over the vent slot. A description of representative types of ridge vents and capping structures, and attributes or problems associated with various types, is found in a prior patent of this inventor, U.S. Pat. No. 5,167,579 (Rotter). That patent discloses, as a solution to many of the problems associated with prior ridge vents, an improved roof ridge venting system using a unitary mat constructed of randomly-aligned synthetic fibers which are joined by phenolic or latex binding agents and heat cured to provide an air-permeable mat with a varying mesh. Cap shingles are supported by the mat and are nailed directly to the roof through the mat. In contrast to other vent materials, the unique features of the mat disclosed in the Rotter patent result in many desirable physical properties such as high tensile strength, high resiliency, the ability to be transported in rolls and cut to length, ease of joining strips, durability in local ambient conditions, and an excellent water and insect barrier. Moreover, it provides the aforementioned desirable features in a thin sheet to permit the vent structure to maintain a low profile along the roof.

Although the vent disclosed in the Rotter patent has desirable applications in many roof types, some of its advantages begin to diminish when it is used in conjunction with metal roofs. Metal roofs panels have a high thermal conductivity and therefore expand and contract with temperature changes during the day and through the seasons. In addition, metal roofs are typically formed of panels having stiffening ribs in which the stiffening rib in proximity to one lateral edge overlaps the stiffening rib in proximity to the other lateral edge of the adjoining panel. It is therefore difficult to create a vent for the passage of air at the ridge while preventing space through which bugs and moisture can pass. It is therefore more common to have ventilation cans on the metal roof, or wall vents located on gable ends of the building rather than ridge vents on metal roofs.

U.S. Pat. No. 5,352,154 (Rotter, et al.) describes a clip that are disposed at intervals on each of the standing seams. A plurality of air-permeable venting material section extend between adjacent clips on one side of the open slot and substantially fill the channels in the clips. A ridge cap overlies the venting material sections and spans the open slot. One shortcoming of this method of using the clips is that the installation is very labor intensive with each clip having to be installed individual and each section of venting material. Furthermore, the planar construction of the mat in the '154 patent does not lend itself to being used with panels having continues corrugation curves.

If is desired to have a structure and method of venting ridges of metal roofs having stiffening ribs which is effective and not labor intensive and capable of working with continues corrugation curves.

SUMMARY OF THE INVENTION

The invention is generally directed to a building structure adapted to allow for ventilation of vapors from within the structure so as to retard deterioration of the structure. A sloped roof has a decking and a sheet overlying the decking. The sheet has a plurality of projects projecting upward away from the decking. The sloped roof has a vent slot disposed along a roof ridge adapted to permit air from an interior space under the roof to flow through the slot to the exterior. A strip has a surface shaped to match the projections of the sheet. The strip has an air permeable and resilient portion. A ridge cap overlies the slot and the strip. The air permeable and resilient portion of the strip is adapted for the flow of vapors.

In a preferred embodiment, the sheet is formed from a plurality of metal panels having stiffening ribs. Each panel having a pair of lateral edges. At least one of the stiffening ribs is in proximity to the one of the lateral edges and overlaps a stiffening rib on an adjoining panel in proximity to the other lateral edge. The strip is entirely an air permeable and resilient strip constructed of randomly aligned synthetic fibers which are open and blended, randomly aligned into a web by an airflow, joined by phenolic or latex binding agents and heat cured to produce a varying mesh, the mat being of unitary sheet construction having no dissimilar sheets laminated or otherwise bonded together.

Further objects, features and advantages of the present invention will become more apparent to those skilled in the art as the nature of the invention is better understood from the accompanying drawings and detailed description.

BRIEF DESCRIPTION OF THE DRAWINGS

For the purpose of illustrating the invention, the drawings show a form which is presently preferred; it being understood, however, that this invention is not limited to the precise arrangements and instrumentalities shown.

DETAILED DESCRIPTION OF THE INVENTION

Figure 1:
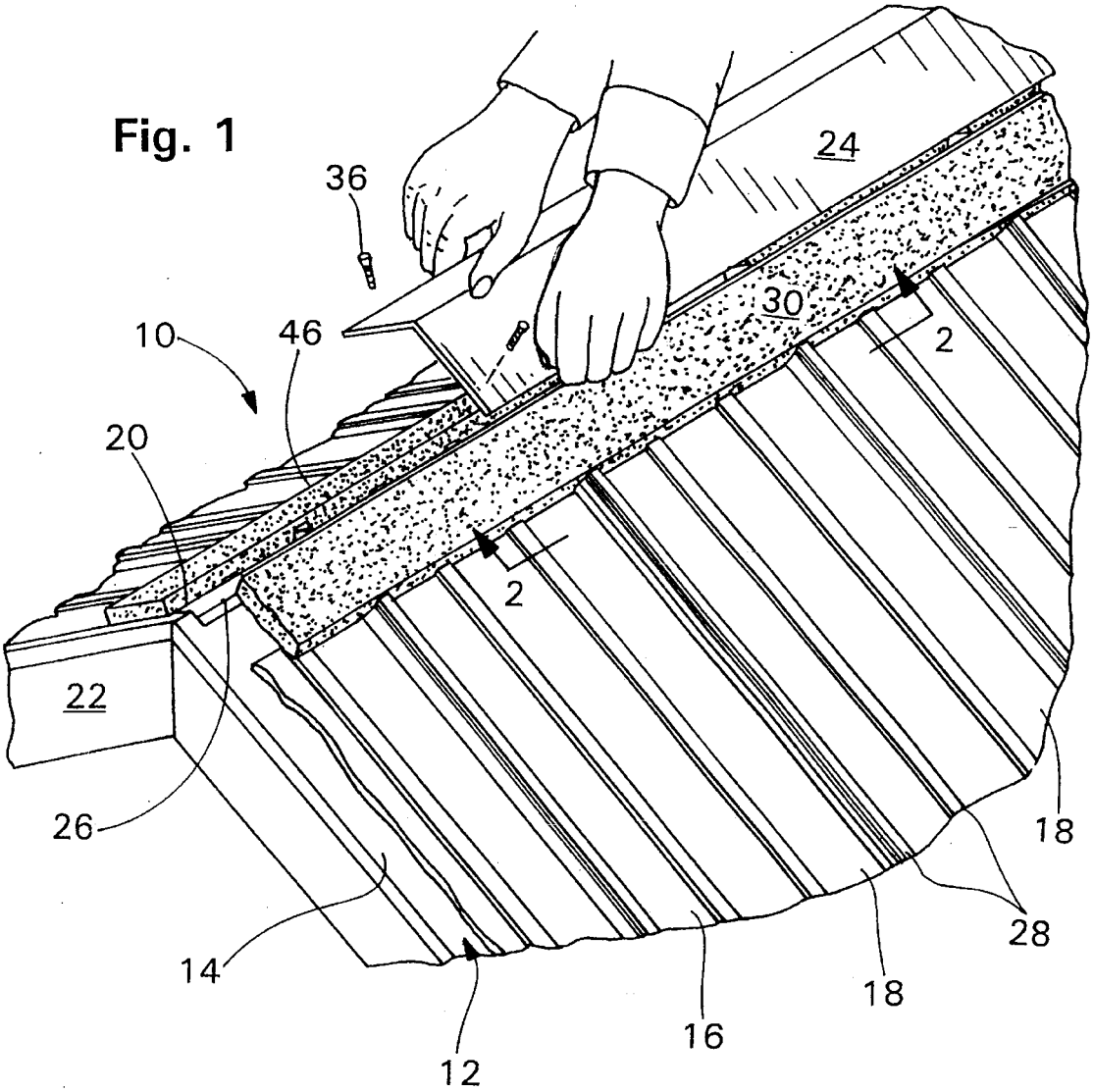
FIG. 1 is a perspective view of a portion of a roof ridge showing the installation of an embodiment of the roof ridge ventilator with the air-permeable resilient strip mounted on the metal roof.

In the drawings, like numerals are used to indicate like elements and primes ('and") are used to indicate counterparts of such like elements. FIG. 1 illustrates one embodiment of a roof venting system designated generally as 10, in accordance with the present invention.

The roof venting system 10 is described in relation to a sloped roof 12 having a decking 14 which is covered by a sheet 16 formed by a plurality of metal panels 18. The roof comes to a ridge 20 at a slope defined by its rafters 22.

In typical prior art metal roof construction, the metal panels 18 extend up to the ridge 20. The metal panels 18 at the ridge 20 are covered with a ridge cap 24, usually made of similar metal as the panels and installed in sections running along the ridge. The ventilation from under the roof is done using can-type ventilators or gable end vents. An open ridge vent slot is not typically found in connection with a metal roof. Consequently, in a metal roof which does not use ridge venting, the upper row of decking, plywood sheathing panels, which underlies the metal panels 18 extends right up to the ridge crest.

Thus, the venting system 10 of this invention is similar to ridge vents more commonly found in asphalt shingle construction and that disclosed in metal roof ventilation system, U.S. Pat. No. 5,353,154. The upper row of sheathing 14 terminates approximately ¾ to 1 inch short of the crest of the ridge, except at the ends of the ridge 20, therein defining an open vent slot 26. The vent slot 26 may be created during construction of the roof, or retro-fitted using a circular saw to cut a slot in the sheathing.

Figure 2:
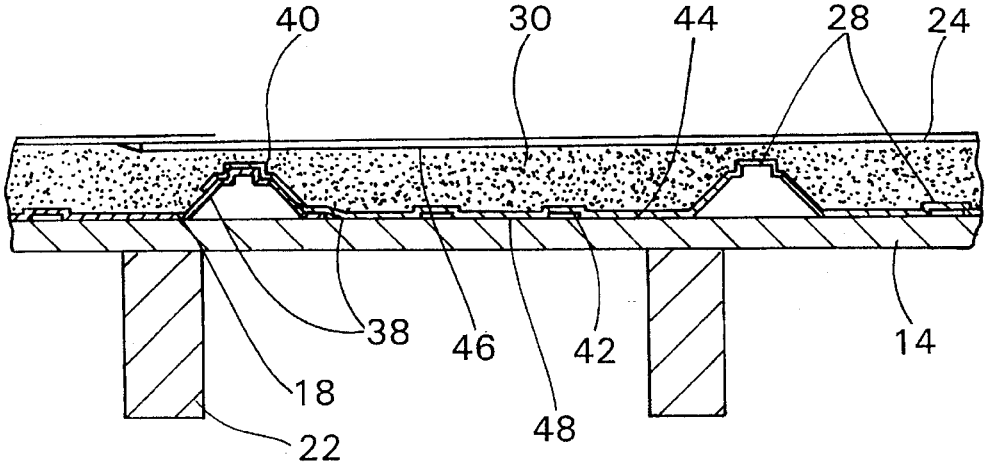
FIG. 2 is a cross-sectional view of the roof ridge ventilator illustrated in FIG. 1 and taken along line 2—2.

The metal panels 18 each have a plurality of projections 28 that project up away from the decking 14. As known to those in the art and shown in FIGS. 2 and 4, adjacent metal panels 18 are joined together to form the sheet 16 by overlying a pair of lateral ends 38 from adjacent panels 18. The projections 28 of the metal panels 18 are both a larger stiffening rib 40 and a smaller squared stiffening rib 42. The larger stiffening ribs 40 in proximity to the lateral edges 38 are used to overlap the adjacent panel.

In this invention, a strip 30 has a lower surface 44 shaped to match the contours of the sheet 16 formed by the metal panels 18 including the projections 28. The strip 30 is secured in proximity to an upper edge 34 of the metal panels 18 and overlies the projections 28. The strip 30 is secured to the metal panels 18 by an adhesive 48.

Figure 3:
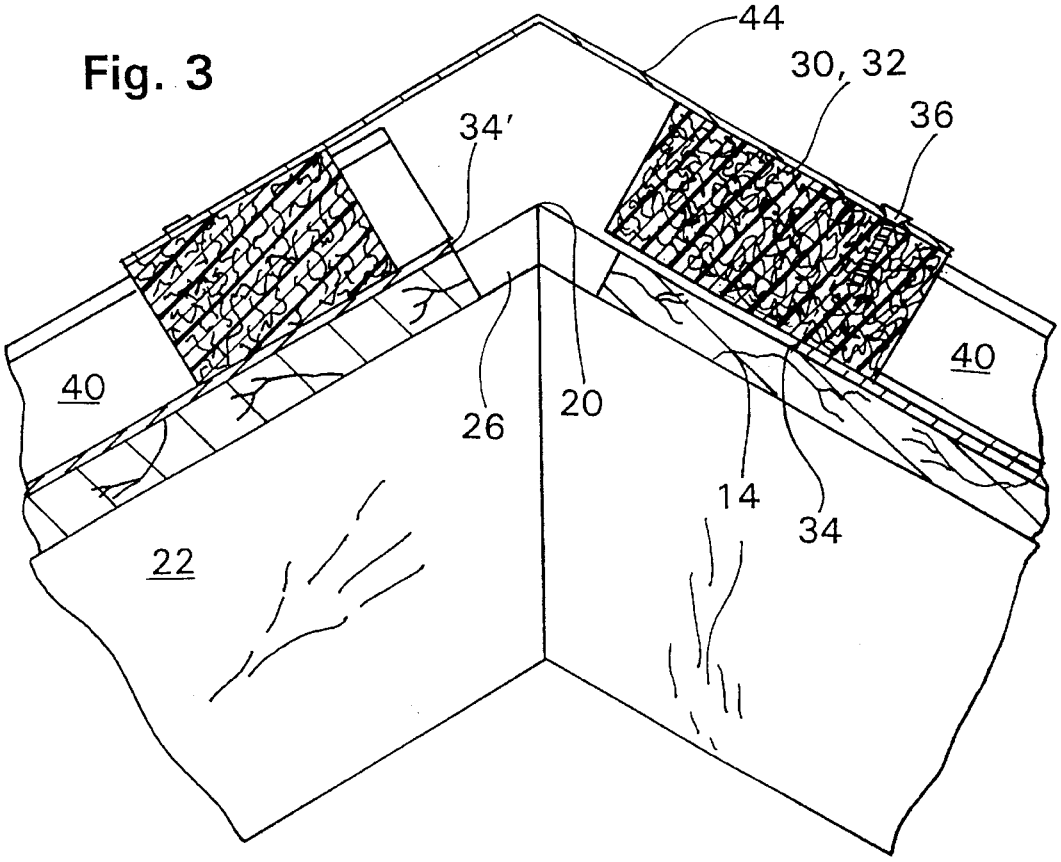
FIG. 3 is a cross-sectional view of a portion of the roof ridge of FIG. 1, showing an embodiment of the roof ridge ventilator of the present invention installed thereon. The left-hand side of the figure shows an alternative positioning of the resilient strip relative to the edge of the metal roof.

The strip 30 has an upper surface 46 which is planar. The ridge cap 24 is secured to the sheet 16 by a series of screw fasteners 36, preferably into one of the larger stiffening ribs 40 as seen in FIG. 3. The thickness of the strip 30 is preferably chosen such that the strip 30 slightly compressed by the ridge cap 24.

The strip 30 has at least a portion that is air permeable to allow the passage of air to ventilate the roof. The strip 30 completely fills the space between the panels 18 and the ridge cap 24 to prevent water, din and insects from entering, but allows the passage of air.

In a preferred embodiment as shown in FIGS. 1–4, the entire strip 30 is an air permeable and resilient strip 32. Although other air-permeable mesh materials could be used, the preferred venting material 32 is a strip of nonwoven synthetic fiber matting, as described in U.S. Pat. No. 5,167,579 (Rotter), which is incorporated by reference, and which further defines the properties of the preferred material.

Figure 4:
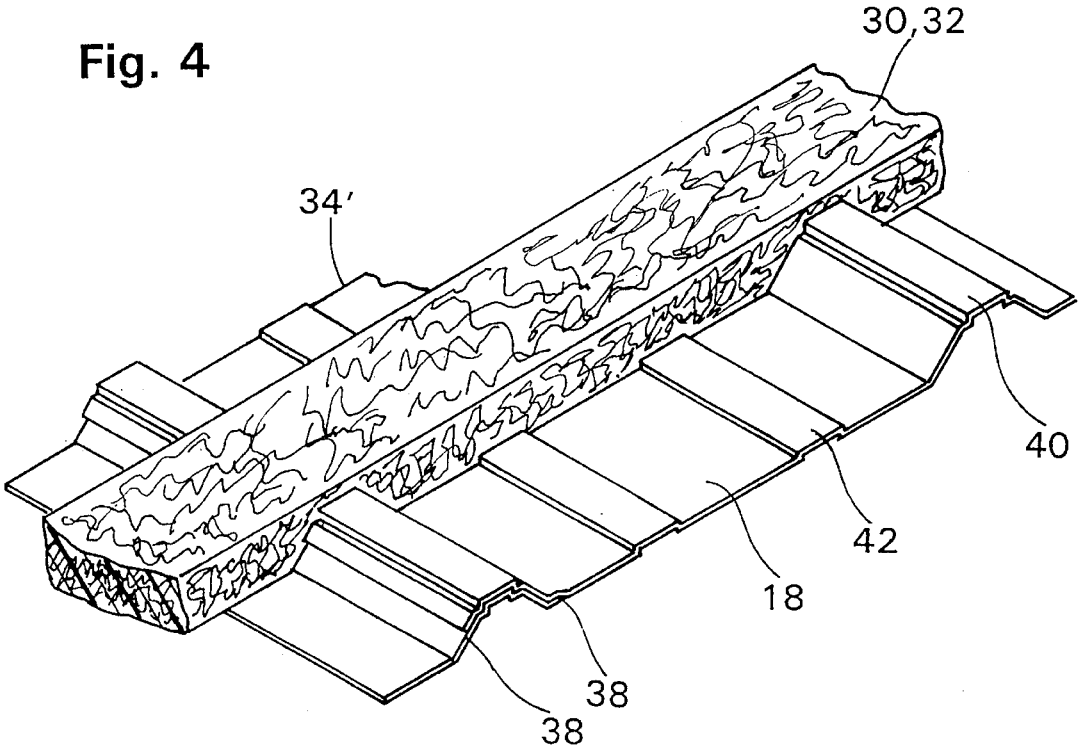
FIG. 4 is an enlarged perspective view of air permeable and resilient strip on the metal roof.

As seen in FIGS. 3 and 4, the relative position of the strip 30 to the upper edge 34 of the metal panels 18 can vary and still meet the objective of this invention. The right-hand side of FIGS. 3 and 4 show the strip 30 extending beyond the upper edge 34 of the metal panels 18. As seen in FIG. 3, the strip 30 overlaps slightly the vent slot 26 in the ridge 20. The left-hand side of FIGS. 3 and 4 show the strip 30 located slightly below or downward from the upper edge 34' of the metal panels 18.

Figure 5:
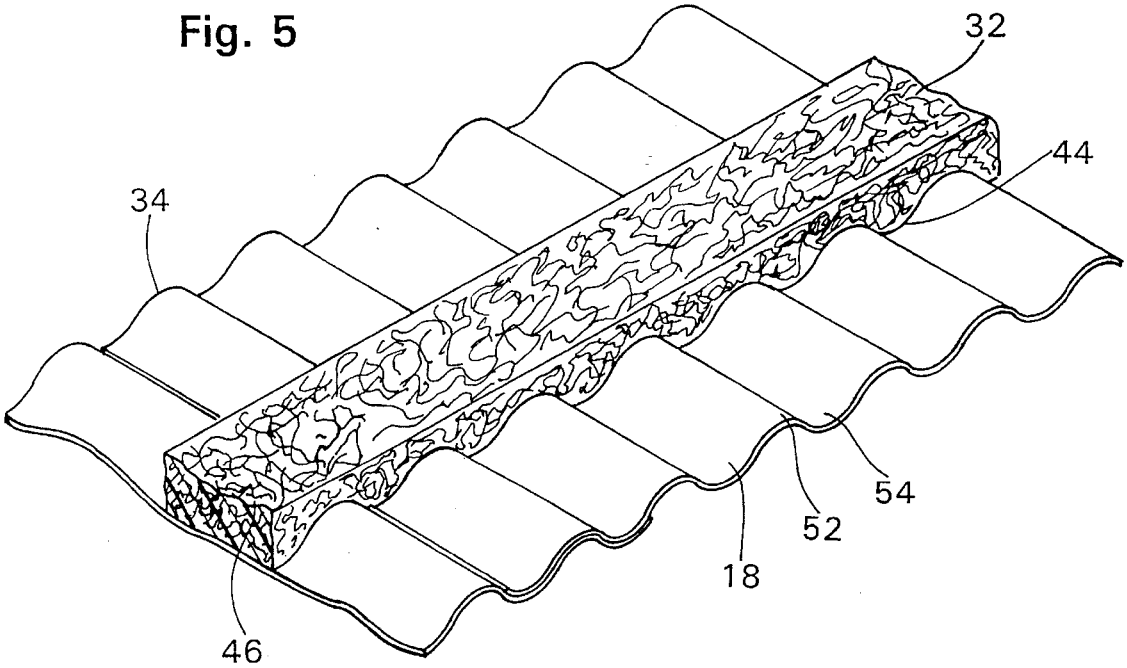
FIG. 5 is an enlarged perspective view of an alternative embodiment of the air permeable and resilient strip on a curved corrugated metal roof.
Figure 6:
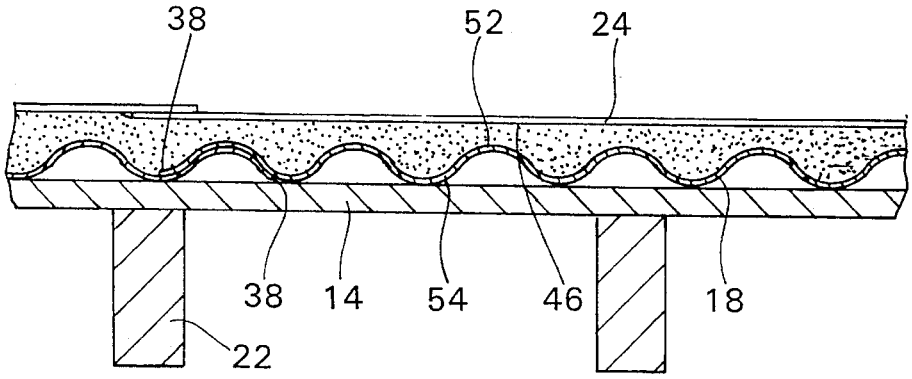
FIG. 6 is a cross-sectional view similar to FIG. 2 for the curved corrugated metal roof.

FIGS. 5 and 6 show an alternative embodiment for a metal sheet 16 having a plurality of metal panels 18 that are a continuous curve corrugated shape. The continuous curve corrugated shape has a plurality of ridges 52 and grooves 54. The air permeable and resilient strip 32 has a lower surface 44 that matches the contour of the metal panels 18. (The strip 30 is entirely air permeable and resilient strip 32 in the embodiments shown, and will be referred to by reference numeral 32). The strip 32 is shown spaced downward or away from the upper edge 34 of the metal panels 18.

The strip 32 completely fills the space between the panels 18 and the ridge cap 24 with a planar upper surface 46 engaging the ridge cap 24. Therefore the air permeable and resilient strip 32 prevents water, dirt and insects from entering, but allows the passage of air. The use of the clips of the '154 patent would not be feasible with a continuous curve corrugated shape, such as in FIGS. 5 and 6, or other continuous changing shaped roof.

Figure 7:
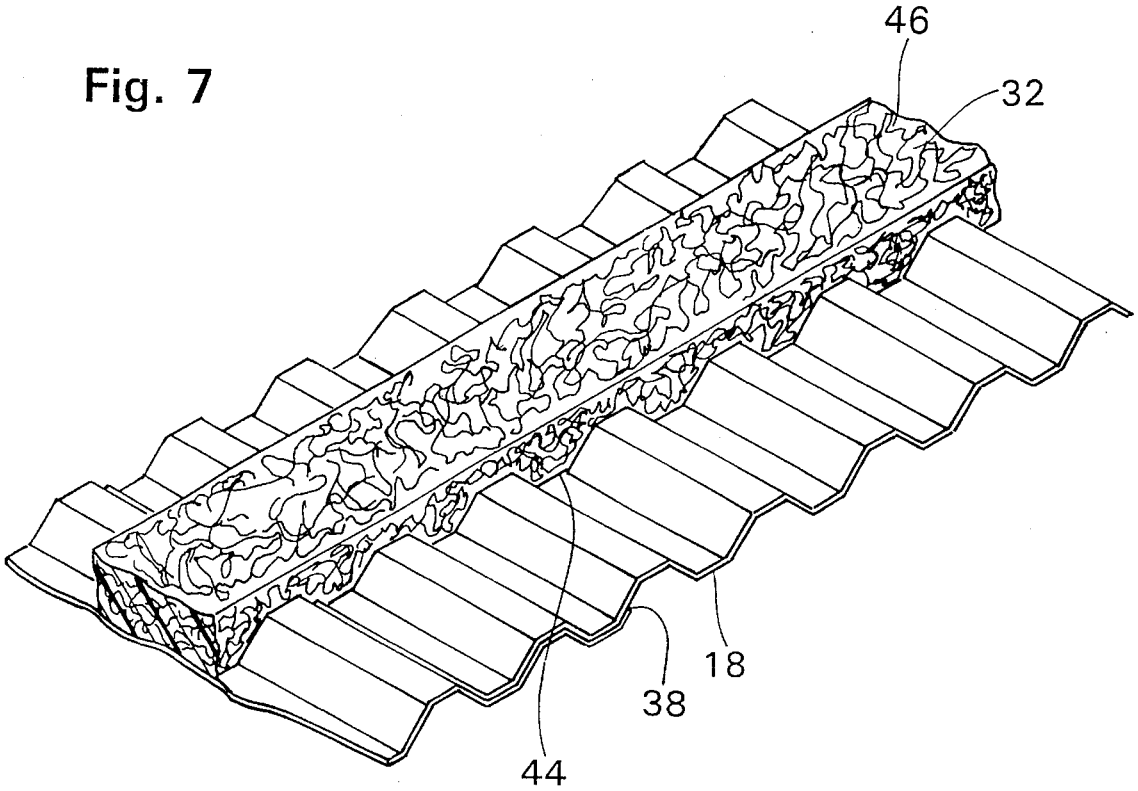
FIG. 7 is an enlarged perspective view of the air permeable and resilient strip on an alternative embodiment, squared wave corrugation, of the metal roof.
Figure 8:
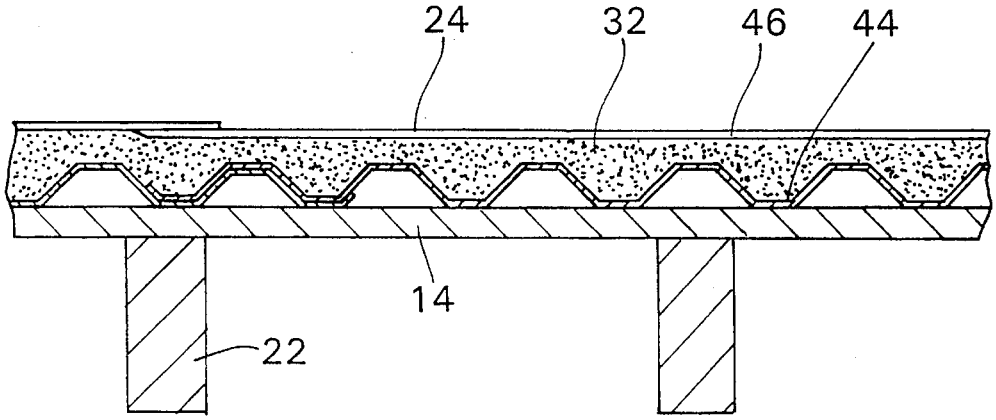
FIG. 8 is a cross-sectional view similar to FIG. 2 for the squared waved corrugated racial roof.

FIGS. 7 and 8 show another alternative embodiment for a metal roof having a plurality of metal panels 18 that forms a continuous uniform squared wave. The strip 32 has a lower surface 44 that matches the contour of the metal panels 18. The upper surface 46 is planar and engages the ridge cap 24. The strip 32 compressing slightly when the ridge cap 24 is secured to ensure a tight fit therein preventing water, dirt and insects from entering, but allowing the passage of air.

Figure 9:
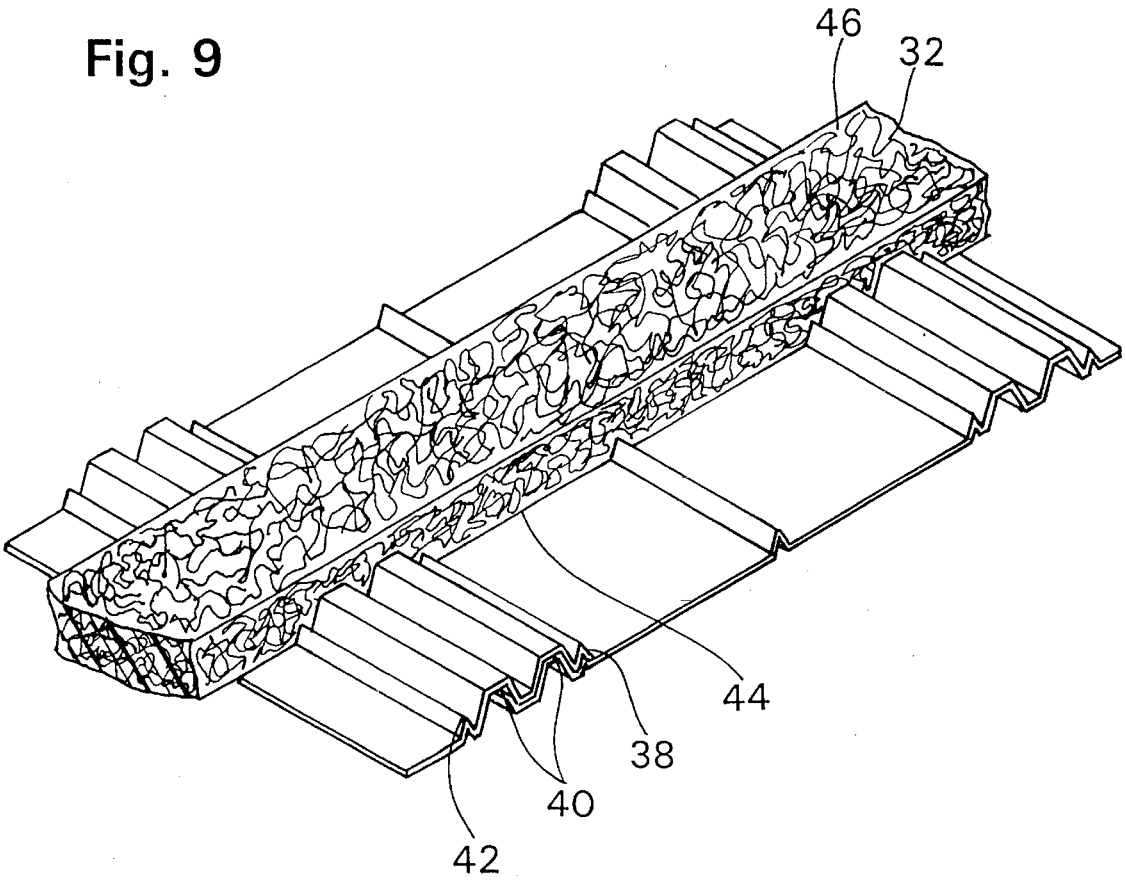
FIG. 9 is an enlarged perspective view of an alternative embodiment of the air permeable and resilient strip on an alternative metal roof.
Figure 10:
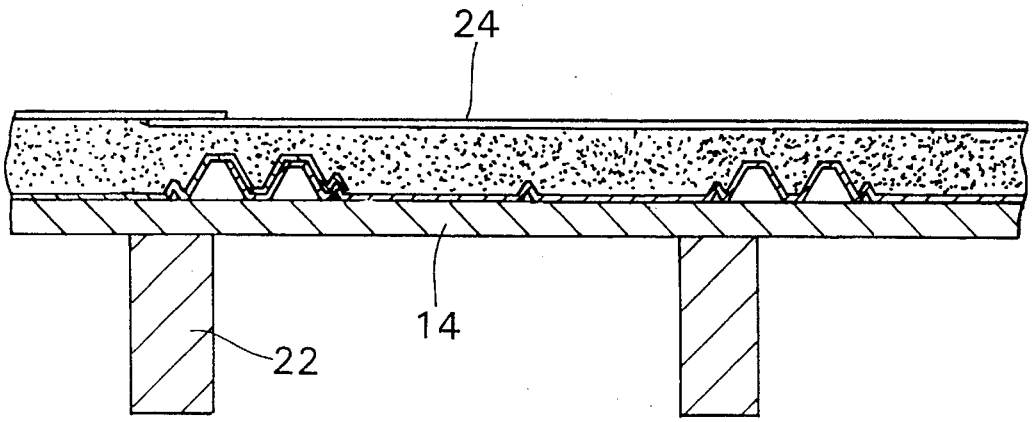
FIG. 10 is a cross-sectional view similar to FIG. 2 for the alternative metal roof.

FIGS. 9 and 10 show another alternative embodiment for a metal roof having a plurality of metal panels 18. Each metal panel has a pair of large square wave stiffening ribs 40 in proximity to each other and adjacent to one of the lateral edges 38. A smaller saw tooth wave stiffening rib 42 border each side of the pair of large square wave stiffening ribs 40. Adjacent the other lateral edge 38 is a portion of a large square wave stiffening rib 40 and a large square wave stiffening rib 40 and the smaller square wave stiffening rib 42 which are overlapped by the those stiffening ribs of the adjacent panel 18. The remaining of the panel has a pattern of a smaller saw tooth wave, spaced from a series of a smaller saw tooth wave, a pair of larger square wave stiffening ribs, and a smaller saw tooth wave. The pattern is repeated. The strip 32 has a lower surface 44 that matches the contour of the metal panels 18. An upper surface 46 of the air permeable and resilient strip 32 is planar and engages the ridge cap 24. The strip 32 compressing slightly when the ridge cap 24 is secured to ensure a tight fit therein preventing water, dirt and insects from entering, but allowing the passage of air.

It is evident from the foregoing that various modifications, which are apparent to those skilled in the art, can be made to the embodiments of this invention without departing from the spirit or scope thereof. For example, and not intending to list all of the possible modifications, it is apparent that fasteners may be substituted for the adhesive where appropriate, and different fasteners such as screws or adhesive for nails. In addition different materials may be used to accomplish the same or equivalent effect as the structures described in the preferred embodiments.

The present invention may be embodied in other specific forms without departing from the spirit or central attributes thereof and, accordingly, reference should be made to the appended claims, rather than to the foregoing specification, as indicating the scope of the invention.

I claim:

1. A building structure adapted to allow for ventilation of vapors from within the structure to an exterior area so as to retard deterioration of the structure, comprising:

a sloped roof having a decking and a sheet overlying the decking;

the sheet having a plurality of projections projecting upward away from the decking;

the sloped roof having a vent slot disposed along a roof ridge adapted to permit air from an interior space under the roof to flow through the slot and to the exterior;

a strip having a surface including a plurality of recesses shaped to match the projections of the sheet, the surface engaging the sheet, the strip having an air permeable and resilient portion; and a ridge cap overlying the slot and the strip, wherein the air permeable and resilient portion of the strip is adapted to allow the flow of vapors from within the structure to an exterior area.

2. A building structure as in claim 1 wherein the sheet is metal and the metal sheet is formed of a series of panels, each panel having a pair of lateral edges, one of the projections in proximity to the one of the lateral edges, the projections overlaps on an adjoining panel in proximity to the other lateral edge.

3. A building structure as in claim 2 wherein the projections are stiffening ribs.

4. A building structure as in claim 2 wherein the metal sheet is corrugated having a series of ridges and grooves, and the projections are ridges.

5. A building structure in accordance with claim 2, wherein the strip is entirely an air permeable and resilient strip constructed of randomly aligned synthetic fibers which are open and blended, randomly aligned into a web by an airflow, joined by phenolic or latex binding agents and heat cured to produce a varying mesh, the mat being of unitary sheet construction having no dissimilar sheets laminated or otherwise bonded together.

6. A method of improving ventilation to a building comprising the following steps:

providing a roof having a vent slot disposed along a roof ridge, the roof having a decking and a metal sheet overlying the decking, the metal sheet having a plurality of projections projecting upward away from the decking;

providing a strip having an air-permeable and resilient portion, the strip having a surface having a shape including a plurality of projections and recesses to complement the projections of the metal sheet;

aligning the recesses in the surface of the strip with the complementary projections of the metal sheet;

installing the strip to the metal sheet so that the surface engages the metal sheet; and installing a ridge cap overlying the slot and the strip.

7. A method of improving ventilation to a building as in claim 6 wherein the step of installing the strip to the metal sheet includes the following sub-steps:

installing an adhesive to the strip; and placing the strip with the adhesive in contact with the metal sheet such that the adhesive bonds with the metal sheet.

8. A method of improving ventilation to a building as in claim 6 wherein the ridge cap is installed to by placing in contact with the strip and driving fasteners through the ridge cap and the metal sheet.

9. A method of installing a metal roof to a building comprising the following steps:

installing a decking to the building;

providing a vent slot disposed along a roof ridge;

installing a plurality of metal panels, the panels each having a pair of lateral sides and a plurality of projections, on the decking such that the projections projecting upward away from the decking and one of the projections in proximity to the one of the lateral edges overlaps the projections on an adjoining panel in proximity to the other lateral edge;

providing an air-permeable and resilient strip having a surface having a shape to compliment the projections of the metal panels;

installing the strip overlying the metal panels in proximity to the vent slot;

installing a ridge cap overlying the slot and the strip.

10. A method of improving ventilation to a building as in claim 9 wherein the step of installing the strip to the metal sheet includes the following sub-steps:

installing an adhesive to the strip; and placing the strip with the adhesive in contact with the metal sheet such that the adhesive bonds with the metal sheet.

11. A method of improving ventilation to a building as in claim 9 wherein the ridge cap is installed to be placed in contact with the strip and driving fasteners through the ridge cap and the metal sheet.

* * * * *

UNITED STATES PATENT AND TRADEMARK OFFICE

CERTIFICATE OF CORRECTION

PATENT NO. : 5,561,953 C1
APPLICATION NO. : 90/007041
DATED : March 25, 2008
INVENTOR(S) : Martin J. Rotter It is certified that error appears in the above-identified patent and that said Letters Patent is hereby corrected as shown below:

Title Page, Item (12), "Rutter" should read -- Rotter --

Title Page, Item (75), delete "Martin J. Rutter" and substitute therefor -- Martin J. Rotter --

Title Page, Item (73), delete "Deutsche Bank AG New York Branch, New York, (NY) (US)" and substitute therefor -- Building Materials Investment Corporation, Wayne, NJ (US) --

Signed and Sealed this
Thirteenth Day of August, 2013

Teresa Stanek Rea
*Acting Director of the United States Patent and Trademark Office*

US005561953C1

(12) EX PARTE REEXAMINATION CERTIFICATE (6160th)

United States Patent

Rotter

(10) Number: US 5,561,953 C1

(45) Certificate Issued: Mar. 25, 2008

(54) CONTOURED VENTILATION SYSTEM FOR METAL ROOFS

(75) Inventor: Martin J. Rotter, Glenside, PA (US)

(73) Assignee: Building Materials Investment Corporation, Wilmington, DE (US)

Reexamination Request:
No. 90/007,041, May 14, 2004

Reexamination Certificate for:

| | |
|---|---|
| Patent No.: | **5,561,953** |
| Issued: | **Oct. 8, 1996** |
| Appl. No.: | **08/347,977** |
| Filed: | **Dec. 1, 1994** |

(51) Int. Cl.

| | |
|---|---|
| ***E04D 13/17*** | (2006.01) |
| ***E04B 7/00*** | (2006.01) |
| ***F24F 7/02*** | (2006.01) |
| ***E04H 12/28*** | (2006.01) |

(52) U.S. Cl. ..... 52/198; 52/302.1; 454/365

(58) Field of Classification Search ..... None
See application file for complete search history.

(56) References Cited

U.S. PATENT DOCUMENTS

| | | | | |
|---|---|---|---|---|
| 429,937 A | | 6/1890 | Mitchell | 428/594 |
| 2,318,820 A | | 5/1943 | Voigt et al. | 52/302.3 |
| 3,949,657 A | | 4/1976 | Sells | 98/42 A |
| 4,024,685 A | | 5/1977 | Aarons | 52/278 |
| 4,189,886 A | | 2/1980 | Frohlich et al. | 52/302 |
| 4,280,399 A | | 7/1981 | Cunning | 98/42 A |
| 4,325,290 A | | 4/1982 | Wolfert | 98/42 A |
| 4,558,637 A | | 12/1985 | Mason | 98/42.21 |
| 4,570,396 A | | 2/1986 | Struben | 52/90 |
| 4,598,505 A | | 7/1986 | McGown | 52/58 |
| 4,754,589 A | * | 7/1988 | Leth | 52/538 |
| 4,754,678 A | * | 7/1988 | Nichols et al. | 83/874 |
| 4,843,953 A | | 7/1989 | Sells | 98/42.21 |
| 4,876,950 A | * | 10/1989 | Rudeen | 454/365 |
| 4,924,761 A | | 5/1990 | MacLeod et al. | 98/42.21 |
| 4,957,037 A | | 9/1990 | Tubbesing et al. | 98/42.21 |
| 4,995,308 A | | 2/1991 | Waggoner | 98/37 |
| 5,002,816 A | | 3/1991 | Hofmann et al. | 428/138 |
| 5,009,149 A | | 4/1991 | MacLeod et al. | 98/42.21 |
| 5,022,203 A | | 6/1991 | Boyd | 52/199 |
| 5,060,431 A | | 10/1991 | MacLeod et al. | 52/199 |
| 5,092,225 A | | 3/1992 | Sells | 454/365 |
| 5,095,810 A | | 3/1992 | Robinson | 454/365 |
| 5,122,095 A | | 6/1992 | Wolfert | 454/365 |
| 5,167,579 A | | 12/1992 | Rotter | 454/365 |
| 5,174,076 A | | 12/1992 | Schiedegger et al. | 52/199 |
| 5,288,269 A | | 2/1994 | Hansen | 454/365 |
| 5,304,095 A | | 4/1994 | Morris | 454/365 |
| 5,326,318 A | | 7/1994 | Rotter | 454/365 |
| 5,328,407 A | | 7/1994 | Sells | 454/365 |
| 5,331,783 A | | 7/1994 | Kasner et al. | 52/199 |
| 5,332,393 A | | 7/1994 | Gödl | 454/365 |
| 5,353,154 A | | 10/1994 | Lutz et al. | 359/582 |
| 5,425,672 A | | 6/1995 | Rotter | 454/365 |
| 5,427,571 A | | 6/1995 | Sells | 454/365 |
| 5,439,417 A | | 8/1995 | Sells | 454/365 |
| 5,458,538 A | | 10/1995 | MacLeod et al. | 454/365 |
| 5,473,847 A | | 12/1995 | Crookston | 52/302.1 |
| 5,542,882 A | | 8/1996 | Sells | 454/365 |
| 5,603,657 A | | 2/1997 | Sells | 454/359 |
| 5,816,014 A | | 10/1998 | Tzeng et al. | 52/745.19 |
| 5,826,383 A | | 10/1998 | Garrison | 52/198 |
| 5,921,863 A | | 7/1999 | Sells | 454/359 |
| 6,079,166 A | | 6/2000 | Mason et al. | 52/198 |

OTHER PUBLICATIONS

"Design Handbook: Section 5" from the Copper.org website at http://www.copper.org/applications/architecture/arch_dhb/tests/batten_seam_roof.html, report date Dep. 26, 1991.*

Onduline Installation Guide, Oct. 1991.

* cited by examiner

*Primary Examiner*—Jeanne M Clark

(57) ABSTRACT

A building structure adapted to allow for ventilation of vapors from within the structure so as to retard deterioration of the structure. A sloped roof has a decking and a sheet overlying the decking. The sheet has a plurality of projects projecting upward away from the decking. The sloped roof has a vent slot disposed along a roof ridge adapted to permit

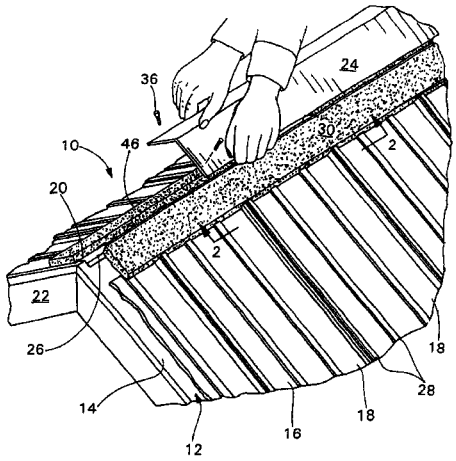

air from an interior space under the roof to flow through the slot to the exterior. A strip has a surface shaped to match the projections of the sheet. The strip has an air permeable and resilient portion. A ridge cap overlies the slot and the strip. The air permeable and resilient portion of the strip is adapted for the flow of vapors.

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 5, 6 and 9 are determined to be patentable as amended.

Claims 2–4, 7, 8, 10 and 11, dependent on an amended claim, are determined to be patentable.

New claims 12–20 are added and determined to be patentable.

1. A building structure adapted to allow for ventilation of vapors from within the structure to an exterior area so as to retard deterioration of the structure, comprising:

a sloped roof having a decking and a *contoured metal roofing* sheet overlying the decking;

the sheet having a plurality of projections projecting upward away from the decking;

the sloped roof having a vent slot disposed along a roof ridge adapted to permit air from an interior space under the roof to flow through the slot and to the exterior;

a strip having a surface including a plurality of recesses shaped to match the projections of the sheet, the surface *of the strip* engaging the sheet *continuously between the projections with the recesses engaging over the projections*, the strip having an air permeable and resilient portion *that is located at least in part between the projections of the sheet that is a barrier against wind driven rain*; and a ridge cap overlying the slot and the strip, wherein the air permeable and resilient portion of the strip is adapted to allow the flow of vapors from within the structure to an exterior area *and to prevent ingress of water, dirt and insects into the building structure*.

5. A building structure in accordance with claim 2, wherein the strip is entirely an air permeable and resilient strip constructed of randomly aligned synthetic fibers which are open and blended, randomly aligned into a web by an airflow, joined by phenolic or latex binding agents and heat cured to produce a varying mesh, the mat being of unitary sheet construction having no dissimilar sheets laminated or otherwise bonded together*, and the plurality of recesses are located in the strip constructed of the randomly aligned synthetic fibers*.

6. A method of improving ventilation to a building comprising the following steps:

providing a roof having a vent slot disposed along a roof ridge, the roof having a decking and a metal sheet overlying the decking, the metal sheet having a plurality of projections projecting upward away from the decking;

providing a strip having an air-permeable and resilient mesh portion, the strip having a surface having a shape including a plurality of projections and recesses to complement the projections of the metal sheet;

aligning the recesses in the surface of the strip with the complementary projections of the metal sheet;

installing the strip to the metal sheet so that the surface engages the metal sheet*, filling a space between the projections in the sheet with the strip, at least a portion of the strip filling the space being part of the air permeable and resilient mesh portion, and allowing a portion of the strip with the recesses to extend over the projections, the strip acting as a barrier against wind driven rain*; and installing a ridge cap overlying the slot and the strip *while compressing the strip to ensure a tight fit of the strip to the metal sheet to allow air flow and to prevent ingress of water, dirt and insects into the building*.

9. A method of installing a metal roof to a building comprising the following steps:

installing a decking to the building;

providing a vent slot disposed along a roof ridge;

installing a plurality of metal panels, the panels each having a pair of lateral sides and a plurality of projections, on the decking such that the projections projecting upward away from the decking and one of the projections in proximity to the one of the lateral edges overlaps the projections on an adjoining panel in proximity to the other lateral edge;

providing an air-permeable and resilient strip having a surface having a shape to [compliment] *complement* the projections of the metal panels;

installing the strip overlying the metal panels in proximity to the vent slot;

*filling a space between the projections in the sheet with the strip, at least a portion of the strip filling the space being part of the air permeable and resilient portion, and allowing a portion of the strip with the recesses to extend over the projections with the surface of the strip continuously engaging the metal panels, the strip acting as a barrier against wind driven rain;* installing a ridge cap overlying the slot and the strip *while compressing the strip to ensure a tight fit to allow air flow and to prevent ingress of water, dirt and insects into the building.*

*12. A building structure according to claim 1, wherein a part of the air permeable and resilient portion of the strip extends over the projections.*

*13. A building structure according to claim 1, wherein the strip is compressed by the ridge cap during installation to completely fill the space between the sheet and the ridge cap with the air permeable and resilient portion comprising an air permeable mesh.*

*14. A building structure according to claim 1, wherein the strip fills a space between the sheet and the ridge cap between the projections with the air permeable and resilient portion comprising an air permeable mesh.*

*15. A building structure adapted to allow for ventilation of vapors from within the structure to an exterior area so as to retard deterioration of the structure, comprising:*

*a sloped roof having a decking and a metal roofing sheet overlying the decking;*

*the metal roofing sheet having a plurality of projections projecting upward away from the decking;*

*the sloped roof having a vent slot disposed along a roof ridge adapted to permit air from an interior space under the roof to flow through the slot and to the exterior;*

*a strip having a bottom surface including a plurality of recesses shaped to match the projections of the roofing sheet, the bottom surface of the strip engaging the sheet continuously between the projections with the recesses engaging over the projections, the strip having an air permeable and resilient mesh portion that forms the bottom surface and is in continuous contact with a surface of the roofing sheet such that the air permeable and resilient mesh portion is located between the projections of the roofing sheet; and*

*a ridge cap overlying the slot and the strip, wherein the air permeable and resilient mesh portion of the strip is adapted to allow the flow of vapors from within the structure to an exterior area and to prevent ingress of water, dirt and insects into the building structure which is capable of preventing water ingress in a wind driven rain test of 8 inches rainfall per hour at 50 m.p.h. wind for a duration of 5 minutes.*

*16. A building structure in accordance with claim 15, wherein the strip is entirely an air permeable and resilient strip.*

*17. A building structure according to claim 1, further comprising a second one of the strips, with one of the strips being located on each side of the vent slot.*

*18. The method of claim 6, further comprising a second one of the strips, wherein one of the strips is installed on each side of the vent slot.*

*19. The method of claim 9, further comprising a second one of the strips, wherein one of the strips is installed on each side of the vent slot.*

*20. A building structure according to claim 15, further comprising a second one of the strips, with one of the strips being located on each side of the vent slot.*

* * * * *

US005561953C2

(12) EX PARTE REEXAMINATION CERTIFICATE (6759th)

United States Patent

Rutter

(10) Number: US 5,561,953 C2

(45) Certificate Issued: Apr. 7, 2009

(54) CONTOURED VENTILATION SYSTEM FOR METAL ROOFS

(75) Inventor: Martin J. Rutter, Glenside, PA (US)

(73) Assignee: Deutsche Bank AG New York Branch, New York, NY (US)

Reexamination Request:
No. 90/009,147, Jun. 16, 2008

Reexamination Certificate for:

| | |
|---|---|
| Patent No.: | **5,561,953** |
| Issued: | **Oct. 8, 1996** |
| Appl. No.: | **08/347,977** |
| Filed: | **Dec. 1, 1994** |

Reexamination Certificate C1 5,561,953 issued Mar. 25, 2008

(51) Int. Cl.

| | |
|---|---|
| ***E04B 7/00*** | (2006.01) |
| ***E04B 1/70*** | (2006.01) |
| ***E04H 12/28*** | (2006.01) |
| ***E04F 17/00*** | (2006.01) |
| ***F24F 7/02*** | (2006.01) |
| ***E04D 13/17*** | (2006.01) |

(52) U.S. Cl. ..... 52/198; 52/302.1; 454/365

(58) Field of Classification Search ..... None
See application file for complete search history.

(56) References Cited

U.S. PATENT DOCUMENTS

| | | | |
|---|---|---|---|
| 1,717,728 | A | 6/1929 | Moore |
| 2,214,183 | A | 9/1940 | Seymour |
| 2,277,758 | A | 3/1942 | Hawkins |
| 2,799,214 | A | 7/1957 | Roose |
| 2,868,104 | A | 1/1959 | Honholt et al. |
| 3,185,070 | A | 5/1965 | Smith |
| 3,222,697 | A | 12/1965 | Scheermesser |
| 3,236,170 | A | 2/1966 | Meyer et al. |
| 3,481,263 | A | 12/1969 | Belden |
| 3,625,134 | A | 12/1971 | Smith |
| 3,660,955 | A | 5/1972 | Simon |
| 3,797,180 | A | 3/1974 | Grange |
| 3,949,657 | A | 4/1976 | Sells |
| 4,073,106 | A | 2/1978 | Malott |
| 4,080,083 | A | 3/1978 | Malott |
| 4,280,399 | A | 7/1981 | Cunning |
| 4,325,290 | A | 4/1982 | Wolfert |
| 4,484,424 | A | 11/1984 | Logsdon |
| 4,520,713 | A | 6/1985 | Arfsten |
| 4,550,648 | A | 11/1985 | Eagle |
| 4,554,862 | A | 11/1985 | Wolfert |
| 4,555,982 | A | 12/1985 | Goubaud |
| 4,607,566 | A | 8/1986 | Bottomore et al. |
| 4,643,080 | A | 2/1987 | Trostle et al. |
| 4,676,147 | A | 6/1987 | Mankowski |
| 4,709,519 | A | 12/1987 | Liefer et al. |
| 4,782,743 | A | 11/1988 | Quinnell |
| 4,817,506 | A | 4/1989 | Cashman |
| 4,843,953 | A | 7/1989 | Sells |
| 4,876,950 | A | 10/1989 | Rudeen |
| 4,878,331 | A | 11/1989 | Taylor |
| 4,899,505 | A | 2/1990 | Williamson et al. |
| 4,903,445 | A | 2/1990 | Mankowski |
| 4,924,761 | A | 5/1990 | MacLeod et al. |
| 4,957,037 | A | 9/1990 | Tubbesing et al. |
| 5,009,149 | A | 4/1991 | MacLeod et al. |
| 5,035,172 | A | 7/1991 | Waggoner |
| 5,052,286 | A | 10/1991 | Tubbesing et al. |
| 5,054,254 | A | 10/1991 | Sells |
| 5,060,431 | A | 10/1991 | MacLeod et al. |

(Continued)

*Primary Examiner*—Aaron J. Lewis

(57) ABSTRACT

A building structure adapted to allow for ventilation of vapors from within the structure so as to retard deterioration of the structure. A sloped roof has a decking and a sheet overlying the decking. The sheet has a plurality of projects projecting upward away from the decking. The sloped roof has a vent slot disposed along a roof ridge adapted to permit air from an interior space under the roof to flow through the slot to the exterior. A strip has a surface shaped to match the projections of the sheet. The strip has an air permeable and resilient portion. A ridge cap overlies the slot and the strip. The air permeable and resilient portion of the strip is adapted for the flow of vapors.

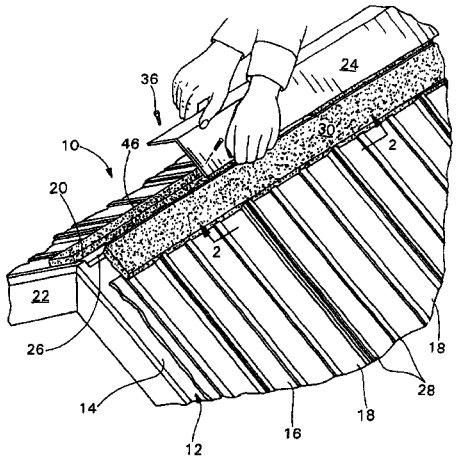

U.S. PATENT DOCUMENTS

| | | | |
|---|---|---|---|
| 5,070,771 | A | 12/1991 | Mankowski |
| 5,092,225 | A | 3/1992 | Sells |
| 5,095,810 | A | 3/1992 | Robinson |
| 5,122,095 | A | 6/1992 | Wolfert |
| 5,122,278 | A | 6/1992 | Longworth et al. |
| 5,149,301 | A | 9/1992 | Gates |
| 5,167,579 | A | 12/1992 | Rotter |
| D336,952 | S | 6/1993 | Raneo |
| 5,304,095 | A | 4/1994 | Morris |
| 5,339,582 | A | 8/1994 | Sells |
| 5,355,644 | A | 10/1994 | Guhl et al. |
| 5,425,672 | A | 6/1995 | Rotter |
| 5,457,920 | A | 10/1995 | Waltz |
| 5,458,538 | A | 10/1995 | MacLeod et al. |
| 5,487,247 | A | 1/1996 | Pigg |
| 5,498,205 | A | 3/1996 | Knowles et al. |
| 5,535,558 | A | 7/1996 | Rieke et al. |
| 5,549,513 | A | 8/1996 | Thomas et al. |
| 5,600,928 | A | 2/1997 | Hess et al. |
| 5,630,752 | A | 5/1997 | Gubash |
| 5,655,964 | A | 8/1997 | Rheault et al. |
| 5,704,834 | A | 1/1998 | Sells |
| 5,738,581 | A | 4/1998 | Rickert et al. |
| 5,749,780 | A | 5/1998 | Harder et al. |
| 5,765,318 | A | 6/1998 | Michelsen |
| 5,772,502 | A | 6/1998 | Smith |
| 5,817,387 | A | 10/1998 | Allwein et al. |
| 5,860,256 | A | 1/1999 | Humber |
| 5,867,956 | A | 2/1999 | Gregory, Jr. et al. |
| 6,141,930 | A | 11/2000 | Allwein et al. |
| 6,149,517 | A | 11/2000 | Hansen |
| 6,227,963 | B1 | 5/2001 | Headrick |
| 6,233,887 | B1 | 5/2001 | Smith |
| 6,260,315 | B1 | 7/2001 | Smith |
| 6,277,024 | B1 | 8/2001 | Coulton |
| 6,277,963 | B1 | 8/2001 | Boulton et al. |
| 6,302,785 | B1 | 10/2001 | McKinney et al. |
| 6,371,847 | B2 | 4/2002 | Headrick |
| 6,684,581 | B2 | 2/2004 | Robinson et al. |
| 7,024,828 | B2 | 4/2006 | Headrick |

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–20 is confirmed.

* * * * *